US005129527A

United States Patent [19]

Lataix

[11] Patent Number: 5,129,527

[45] Date of Patent: Jul. 14, 1992

[54] CHILD RESISTANT BLISTER PACKAGE

[75] Inventor: Gilbert Lataix, Chatel Guyon, France

[73] Assignee: Merck & Co., Inc., Rahway, N.J.

[21] Appl. No.: 776,015

[22] Filed: Oct. 15, 1991

[51] Int. Cl.[5] ..... B65D 85/58; A61J 1/00

[52] U.S. Cl. ..... 206/539; 206/461; 206/807

[58] Field of Search ..... 206/461–465, 206/467–471, 528, 531, 532, 534, 534.1, 534.2, 538, 807

[56] References Cited

U.S. PATENT DOCUMENTS 3,144,343 8/1964 Fritsche ..... 206/463
3,856,144 12/1974 Kelly ..... 206/469
4,192,422 3/1980 Kotyuk ..... 206/468
4,921,102 5/1990 Van Erden ..... 206/470
4,974,729 12/1990 Steinnagel ..... 206/534.1
5,033,616 7/1991 Wyser ..... 206/532

*Primary Examiner*—Jimmy G. Foster
*Attorney, Agent, or Firm*—Salvatore C. Mitri; Charles M. Caruso

[57] ABSTRACT

There is disclosed a child resistant blister package comprising a conventional blister package having cavities containing unit doses of medication. The blister package is adapted to receive a locking member which is slidably secured to the blister package to effectively prevent children from accessing the medication therein and yet is readily, slidably removed from the blister package by an adult to access medication therefrom.

5 Claims, 4 Drawing Sheets

CHILD RESISTANT BLISTER PACKAGE

BACKGROUND OF THE INVENTION

This invention is directed toward a child resistant blister package of the type commonly used to package multiple units of medication in tablet or pill form. Such blister packages typically comprise a plastic laminate film having a plurality of cavities formed therein in which units of medication in pill or tablet form are placed and an aluminum cover sheet which overlies the cavities and is adapted to be sealed to the plastic laminate. To remove a pill or tablet, one manually pushes the pill or tablet through the aluminum cover sheet. In other types of commercial blister packages, the aluminum cover sheet is adapted to be peelably sealed to the plastic laminate so that a pill or tablet can be accessed by peeling the aluminum cover sheet off of the plastic laminate.

Due to the relative ease with which the cover sheet of these commercial blister packages can be peeled off or punctured, their medication contents can be readily accessed by children who, imitating their elders, can accidentially ingest medication that may be harmful to them.

SUMMARY OF THE INVENTION

It has now been found that these commercial blister packages can be made to be effectively child resistant by the child resistant blister package of this invention.

The child resistant blister package of the invention generally comprises a typical blister package adapted to receive a locking member which can readily be slidably secured to and slidably removed from the blister package. When secured to the blister package, the locking member prevents access to the unit doses of medication but upon being slidably removed, the medication is readily accessible.

In summary, the child resistant blister package of the invention comprises a blister package having a plurality of cavities containing units of medication in pill or tablet form. The blister package is adapted to have opposed, extended sides in which are formed a plurality of spaced notches. Adjacent to and inboard from the spaced notches on each side is a rib member which is parallel to and substantially the same length as the extended sides. Preferably, a second rib member is also provided parallel to and spaced inwardly from the first rib member. The height of the second rib member is about the height of the cavities containing the unit doses of medication while the height of the rib member is about half that of the second rib member.

The locking member for the blister package is generally rectangularly shaped as is preferably fabricated or molded from a suitable plastic material such as polypropylene to facilitate its ability to be slidably secured to and slidably removed from the blister package. Thus, the generally rectangular locking member has opposed top and bottom walls, opposed inner and outer side walls and opposed end walls.

A T-shaped key slot is formed in and extends through the body and the opposed end walls of the locking member. An open channel is provided in the inner side wall at the head of the T-shaped key slot forming opposed upward and downward extensions. The channel extends the length of the locking member and communicates with the head of the T-shaped key slot. The leg of the T-shaped key slot adjacent the outer side wall defines a groove which extends through the length of the locking member and which also communicates with the head of the T-shaped key slot.

Formed in either the top wall or bottom wall or both walls are a plurality of L-shaped lock and release tabs, the long legs of which are co-planar with the top (or bottom) wall and the short legs of which are co-planar with the outer side wall and have an inwardly projecting flange. The L-shaped lock and release members are positioned so that their inwardly projecting flanges are aligned with and engage the notches formed in the extended sides of the blister package. The edges of each of the long legs of the L-shaped lock and release tabs are secured to the top (or bottom) wall adjacent the inner side wall while the remaining edges are not secured. This enables the lock and release tabs to be manually flexed to disengage the inwardly projecting flanges from the notches in the extended sides of the blister package permitting the locking member to be slidably removed from the blister package.

In assembly, the blister package is folded so that the notches and the rib members in its extended sides are respectively in superimposed alignment with each other. The locking member is then slidably secured to the superimposed, extended sides of the blister package so that the outermost rib member is received by and contained within the head of the T-shaped key slot; the superimposed, extended sides of the blister package inboard of the outer rib member are received by and contained within the open channel by impingement by and between the upward and downward extensions; and, the inwardly projecting flanges of the short legs of L-shaped lock and release tabs are mated with and engage the notches.

To assemble the locking member to the blister package in this manner, the L-shaped lock and release tabs are manually flexed to increase the gap of the channel between the upward and downward extensions an amount sufficient to receive the superimposed extended sides of the blister package therebetween and enable the locking member to be slidably secured to the blister package as described above.

To remove the locking member from the blister package and access the units of medication, the L-shaped lock and release tabs are manually flexed to release the impingement action of the upward and downward extensions and disengage the inwardly projecting flanges from the notches enabling the locking member to be slidably removed while maintaining the lock and release tabs in their flexed positions.

DETAILED DESCRIPTION OF THE INVENTION

The child resistant blister package of the invention will become more apparent from the ensuing description when considered together with the accompanying drawing wherein like reference numerals denote like parts and wherein.

Figure 1:
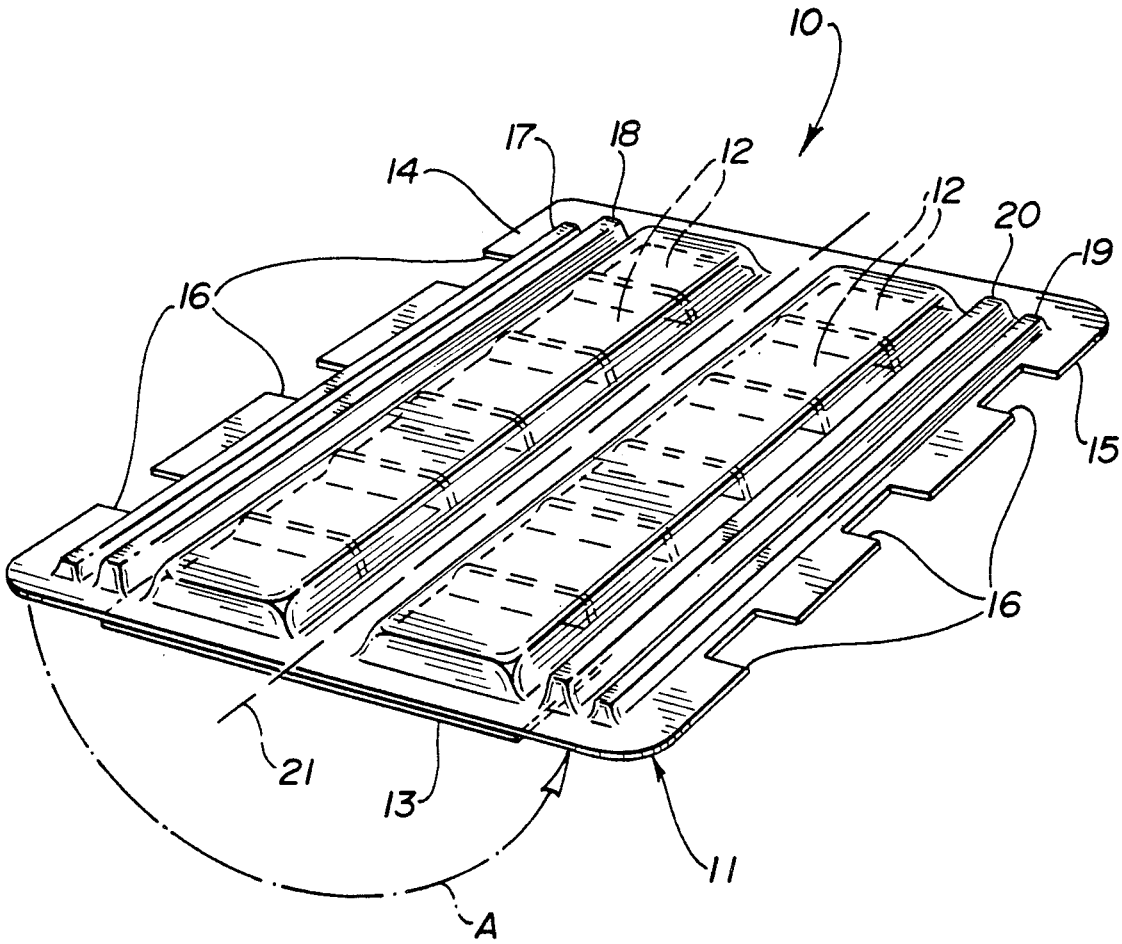
FIG. 1 is a perspective view of the child resistant blister package of the invention.

As shown in FIG. 1, a conventional blister package, generally identified by reference numeral 10, typically comprises a plastic laminate film 11 in which a plurality of cavities 12 have been formed to contain units of medication in pill or tablet form (not shown). An aluminum cover sheet 13 overlies the cavities 12 and is bonded to the plastic laminate film 11 to complete the blister package.

To provide the child resistant blister package of the invention, the blister package 10 is adapted to have opposed, extended sides 14, 15, each of which has a plurality of notches 16 formed along their edges. Spaced inwardly from notches 16 on each side 14, 15 are a pair of upwardly extending parallel ribs 17, 18 and 19, 20, respectively, which are substantially coextensive with the length of extended sides 14, 15. Outboard ribs 17 and 19 are fabricated to be about half the height of inboard ribs 18 and 20 and sized to be closely received within the head of the T-shaped key slot of the locking member as described in more detail hereinbelow.

Figure 2:
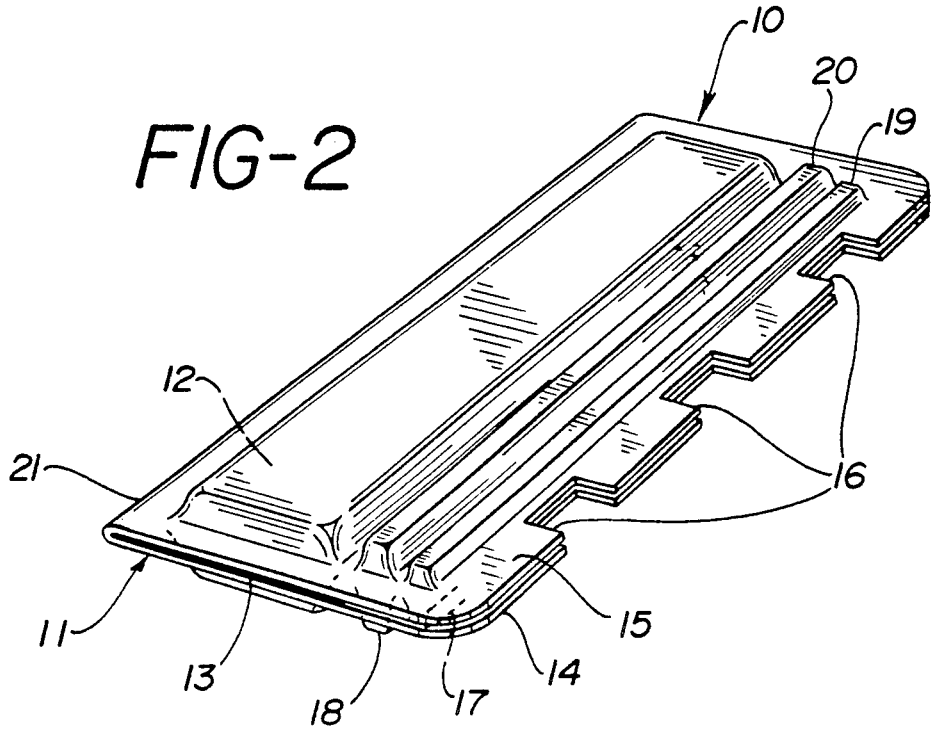
FIG. 2 is a perspective view of the blister package of FIG. 1 after it has been folded and is ready to receive the locking member.
Figure 6:
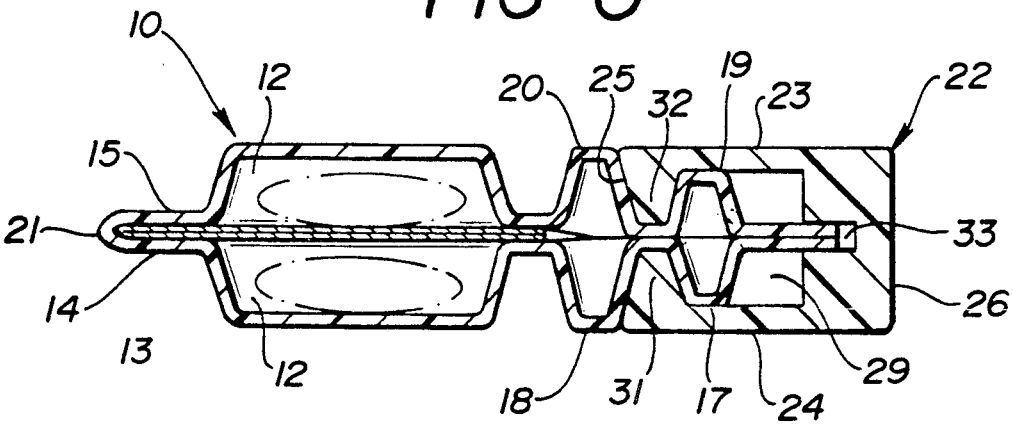
FIG. 6 is a view taken substantially on the line 6—6 of FIG. 5.

To receive the locking member of the invention, blister package 10 is folded along its mid-longitudinal axis, indicated in dashed lines by reference numeral 21, in the direction of arrow A as shown in FIG. 1 so that extended side 15 overlays and is superimposed upon extended side 14 with notches 16 in superimposed, common alignment and ribs 17, 19 and 18, 20, respectively, in substantial vertical alignment with one another as can be seen in FIGS. 2 and 6. Thus, mid-longitudinal axis 21 serves as a hinge area when superimposing and overlaying the extended sides on one another. Alternatively, two blister packages 10 can be superimposed upon one another (not shown) with their extended sides overlying one another and their notches in common alignment.

Figure 3:
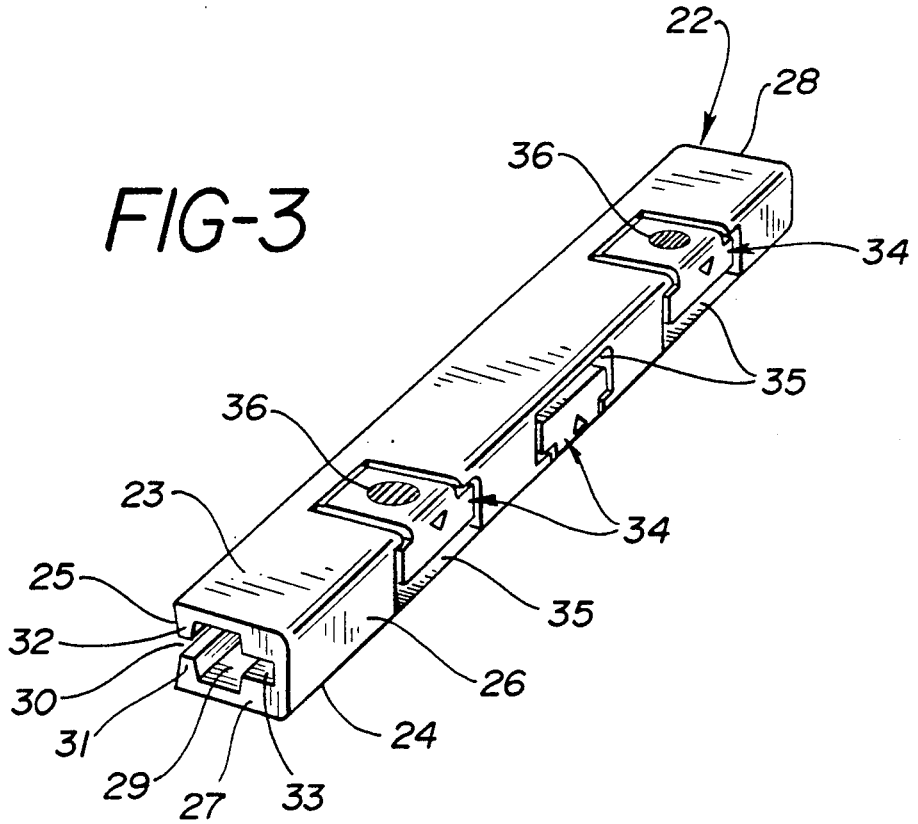
FIG. 3 is a perspective view of the locking member for the blister package.

As shown in FIG. 3, the locking member of the invention, identified by reference numeral 22, is generally rectangular and has opposed top and bottom walls 23, 24, opposed inner and outer side walls 25, 26 and opposed end walls 27, 28. Extending through the body as well as end walls 27, 28 of locking member 22 is a T-shaped key slot 29. An open channel 30 is provided in inner side wall 25 that extends the length of locking member 22 communicating with the head of T-shaped key slot 29 and forming opposed upward and downward extensions 31, 32. The leg of T-shaped key slot 29 adjacent outer side wall 26 defines a groove 33 which also extends throughout locking member 22 and communicates with the head of T-shaped key slot 29.

Figure 4:
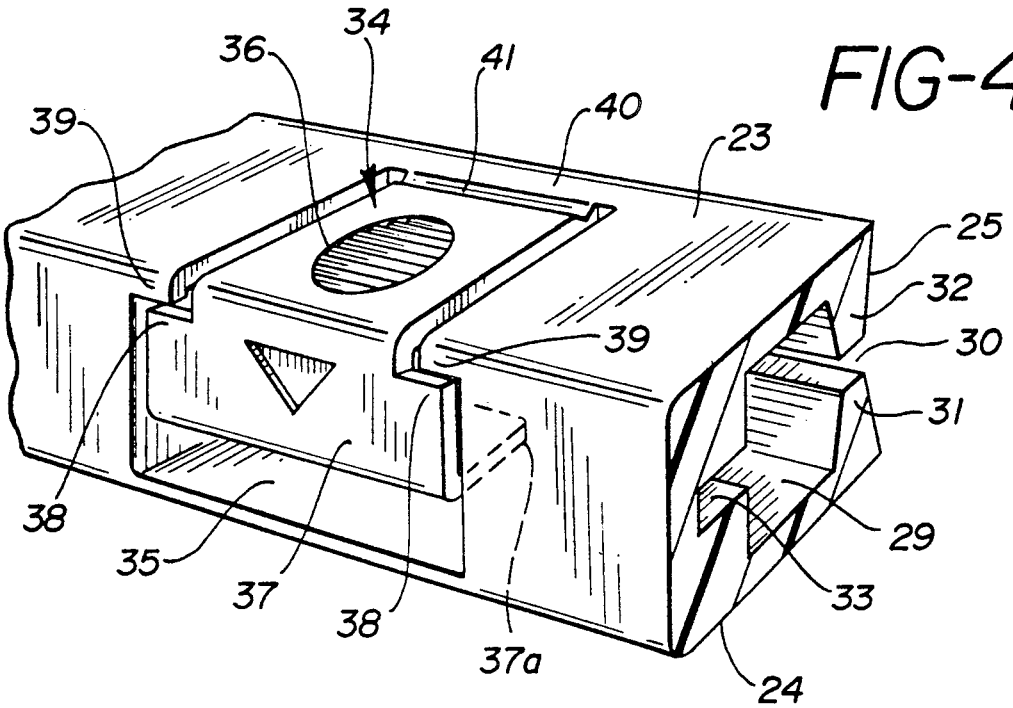
FIG. 4 is a perspective view showing details of the lock and release tabs of the locking member.
Figure 4A:
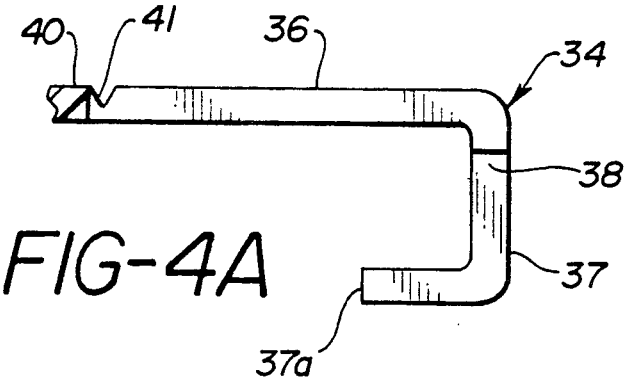
FIG. 4A is a side elevation view showing further details of an isolated lock and release tab.

As illustrated in FIGS. 3, 4 and 4A, the locking member 22 is provided with a plurality of L-shaped tabs, generally identified by reference numeral 34, which can be positioned in either the top wall 23 or bottom wall 24 or both top and bottom walls 23, 24 of the locking member 22 (FIG. 3). These L-shaped tabs 34 are fitted within L-shaped openings 35 in the locking member 22 (FIG. 3) in mating relationship so that the long legs 36 of L-shaped tabs 34 are co-planar with a top or bottom wall 23 or 24 and their short legs 37 are co-planar with the outer side wall 26 of locking member 22 as best seen in FIG. 4. Preferably, three L-shaped tabs 34 are provided in the locking member 22 and are spaced from each other so that an adult can readily, manually flex them concurrently with the fingers of one hand, but a child would have difficulty attempting to perform the same manipulation.

As also shown in FIG. 4, the juncture of long legs 36 and short legs 37 of L-shaped tabs 34 are preferably notched as at 38 to mate with corresponding shoulders 39 formed at the juncture of the top wall 23 (or the bottom wall 24) of locking member 22. The edge of the long legs 36 of the L-shaped tabs 34 are secured to the top wall 23 (or bottom wall 24) adjacent the inner side wall 25, as indicated at 40 in FIG. 4, while the remaining edges of L-shaped tabs 34 are closely spaced from the top wall 23 (or bottom wall 24) of the locking member 22. The ends of short legs 37 are provided with inwardly projecting flanges 37*a* (FIG. 4A) which engage notches 16 when the locking member 22 and blister package are assembled.

To impart a greater degree of hinge-like flexibility to L-shaped tabs 34, a transverse notch 41 (FIGS. 4A, 7 and 8) is provided in long legs 36 adjacent their point of securement 40 to top wall 23 (or bottom wall 24).

Figure 5:
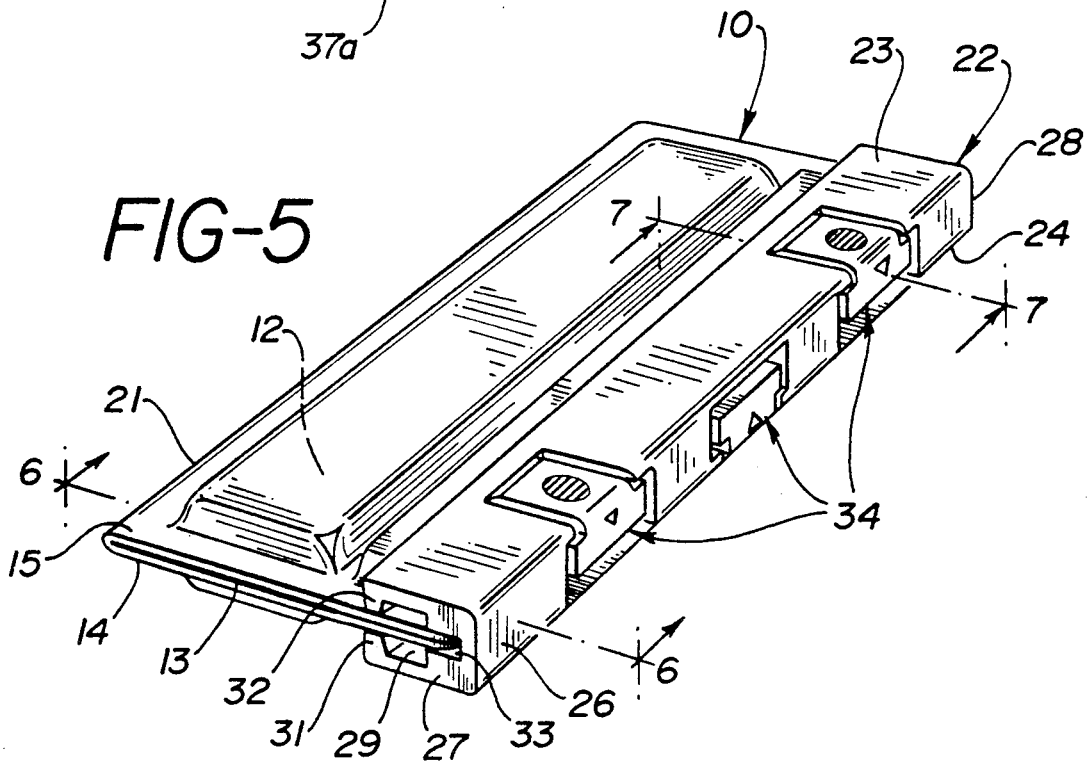
FIG. 5 is a perspective view showing the blister package of FIG. 2 and the locking member of FIG. 3 when assembled.
Figure 7:
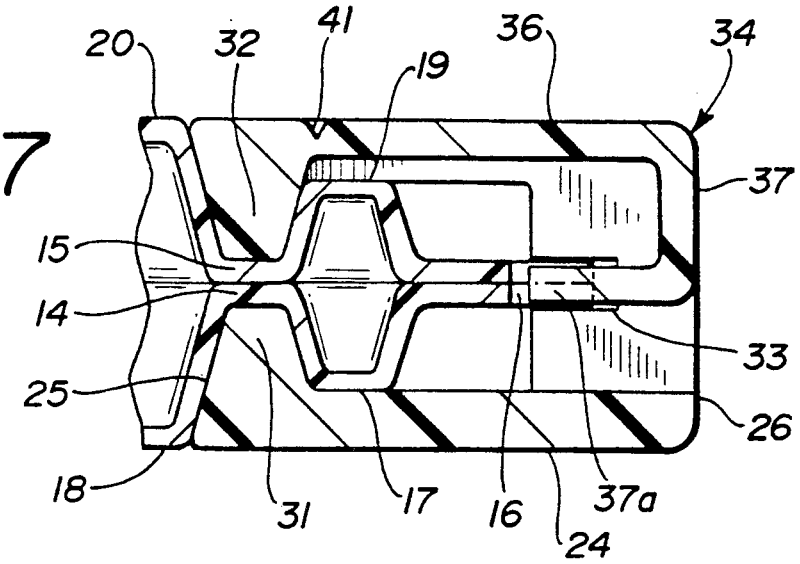
FIG. 7 is an exaggerated view taken substantially on the line 7—7 of FIG. 5 showing a lock and release tab in a locked position; and, FIG. 8 is a view similar to that of FIG. 7 showing the flexed, unlocked position of a lock and release tab.

When assembled, the blister package 10 and the locking member 22 appear as depicted in FIGS. 5 and 6 with extensions 31 and 32 impinging upon and securing therebetween extended sides 14, 15 in the area defined between inner ribs 18, 20 and outer ribs 17, 19 to closely contain outer ribs 17, 19 within the head of T-shaped key slot 29 and with inwardly projecting flanges 37*a* of L-shaped tabs in mating, locking engagement with notches 16 as shown in FIG. 7. This interfitting relationship coupled with the relatively greater height of inner ribs 18, 20 prevents the locking member 22 from being removed from the blister package 10 by a child.

Figure 8:
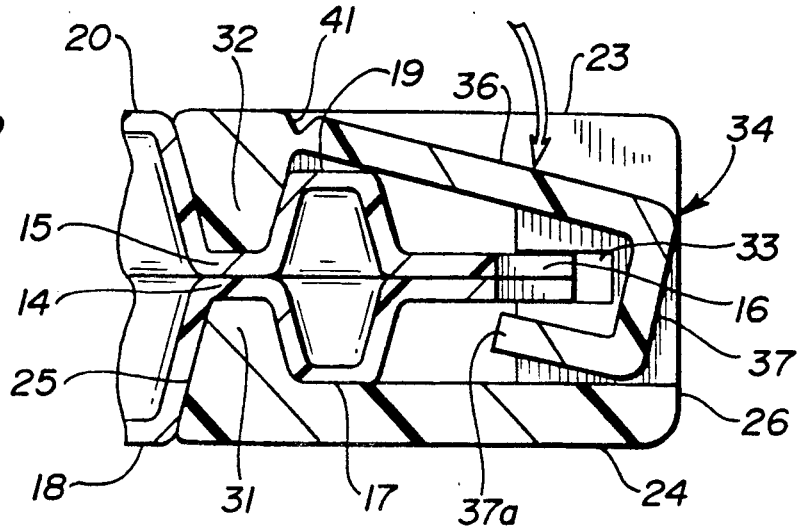

To remove the locking member 22 from the blister package 10, the long legs 36 of L-shaped tabs 34 are manually flexed at 41 to release the impingement action of extensions 31, 32 on extended sides 14, 15 and disengage the inwardly projecting flanges 37*a* from notches 16 as illustrated in FIG. 8. The locking member 22 can then be removed from the blister package 10 by sliding it longitudinally along ribs 18, 20 and 17, 19 until it is completely disengaged. The blister package can then be unfolded and medication removed therefrom in the usual manner.

Reassembly of the blister package 10 and the locking member 22 is accomplished by reversing these steps; i.e., folding the blister package 10 and, manually flexing long legs 36 of L-shaped tabs 34 an amount sufficient to permit extended sides 14, 15 to be slidably received between extensions 31, 32 and re-positioned between inner ribs 18, 20 and outer ribs 17, 19 with outer ribs 17, 19 closely contained within the head of T-shaped key slot 29 and inwardly projecting flanges 37*a* in locking engagement with notches 16. Inner ribs 18, 20 also serve as guide means as the locking member 22 is being slideably secured to the blister package 10 during reassembly.

While the child resistant blister package of the invention has been described with particularity and in some detail, it should be understood and will be apparent to those skilled in the art that variations and modifications can be made therein without departing from the scope of the invention recited in the claims.

What is claimed is:

1. A child resistant blister package comprising:

(i) a blister package formed from a film having a plurality of cavities formed therein in which units of medication are placed and a cover sheet which overlies said cavities and which is bonded to said film, said blister package adapted to have:

(a) opposed, extended sides;

(b) a plurality of spaced notches formed in said opposed, extended sides;

(c) a pair of raised, parallel rib members provided on and substantially co-extensive with each of said opposed, extended sides, said pairs of rib members being positioned inboard of said notches and spaced from each other;

(d) means to overlay said opposed, extended sides such that said pairs of parallel ribs and said notches are in vertical superimposed alignment with each other; and, (ii) a generally rectangular locking member having opposed top and bottom walls, opposed side walls and opposed end walls, said locking member having:

(a) a T-shaped key slot formed within said locking member and extending through said opposed end walls;

(b) a channel formed in a side wall of said locking member communicating with the head of said T-shaped key slot and defining opposed upward and downward extensions capable of receiving and impinging therebetween the overlaid, opposed extended sides of said blister package, the head of said T-shaped key slot capable of receiving therein in close fitting relationship the outermost superimposed and aligned rib members;

(c) a plurality of L-shaped lock and release tabs formed in at least one of said opposed top or bottom walls, the long legs of said L-shaped tabs being substantially co-planar with said top or bottom wall and the short legs of said L-shaped tabs being substantially co-planar with the closed side wall of said locking member opposite said channel, only the terminal edges of the long legs of said L-shaped tabs being secured to said top or bottom wall adjacent the side wall containing said channel, the short legs of said L-shaped tabs having inwardly projecting flanges capable of mating with said notches in locking engagement such that manual flexing of said L-shaped lock and release tabs permits said locking member to be slidably removed from or mounted on said blister package and, when mounted on said blister package, release of said manual flexing permits said opposed upward and downward extensions to impinge therebetween the overlaid, opposed extended sides of said blister package and mating of said inwardly projecting flanges in locking engagement with said notches.

2. The blister package of claim 1 wherein opposed notches are formed at the juncture of the long legs and short legs of said L-shaped tabs which mate with shoulders formed in the adjacent side wall of said locking member such that said L-shaped tabs can be manually flexed in only one direction.

3. The blister package of claim 1 wherein in said pairs of parallel rib members, the outermost rib member is about half the height of the innermost rib member.

4. The blister package of claim 1 wherein said opposed upward and downward extensions impinge said extended sides in the area defined between said pairs of parallel rib members.

5. The blister package of claim 1 wherein said locking member contains at least three of said L-shaped lock and release tabs which are spaced from each other such as to enable an adult to concurrently flex them with the fingers of one hand.

* * * * *